US006715208B2

(12) United States Patent
Lemisch

(10) Patent No.: US 6,715,208 B2
(45) Date of Patent: Apr. 6, 2004

(54) THUMB LOCK FOR A BUTTERFLY KNIFE

(76) Inventor: Adam M. Lemisch, 29005 N. 51st Pl., Cave Creek, AZ (US) 85331

( * ) Notice: Subject to any disclaimer, the term of this patent is extended or adjusted under 35 U.S.C. 154(b) by 0 days.

(21) Appl. No.: 10/217,663

(22) Filed: Aug. 12, 2002

(65) Prior Publication Data

US 2004/0025354 A1 Feb. 12, 2004

(51) Int. Cl.[7] ..... B26B 3/06
(52) U.S. Cl. ..... 30/153; 30/161; 30/340
(58) Field of Search ..... 30/153, 154, 157, 30/161, 340, 155; 7/118

(56) References Cited

U.S. PATENT DOCUMENTS 847,206 A * 3/1907 Saunderson ..... 30/153
1,549,545 A * 8/1925 Hickman ..... 30/153
1,659,418 A * 2/1928 Werner ..... 30/153
1,665,955 A * 4/1928 Gatewood ..... 30/153
4,364,174 A * 12/1982 De Asis ..... 30/153
4,547,965 A * 10/1985 Moore ..... 30/153
4,669,140 A * 6/1987 Miceli ..... 7/158
4,672,743 A * 6/1987 Grahm ..... 30/153
4,893,409 A * 1/1990 Poehlmann ..... 30/161
5,095,624 A * 3/1992 Ennis ..... 30/161
6,195,898 B1 * 3/2001 Lemisch ..... 30/153

* cited by examiner

*Primary Examiner*—Boyer D. Ashley
(74) *Attorney, Agent, or Firm*—Jeffrey D. Moy; Harris M. Weiss; Weiss, Moy & Harris, P.C.

(57) ABSTRACT

A butterfly knife has a locking mechanism. The butterfly knife has a first handle component, a second handle component, and a blade hingedly coupled at a proximal end of the butterfly knife. The first and second handle components are moveable to an open position and a closed position. The locking mechanism is coupled to the proximal end of the butterfly knife for securing the butterfly knife in an open position and a closed position.

7 Claims, 3 Drawing Sheets

THUMB LOCK FOR A BUTTERFLY KNIFE

RELATED APPLICATION

This application is related to U.S. Pat. No. 6,195,898 filed Dec. 4, 1998, naming Adam M. Lemisch as the inventor, and entitled "MAGNETICALLY LATCHING BUTTERFLY KNIFE." The above application is hereby incorporated by reference.

BACKGROUND OF THE INVENTION

1. Field of the Invention

This invention relates generally to knives, and more specifically, to a device for locking a knife, specifically a butterfly knife.

2. Background of the Invention

A butterfly knife generally has a blade, a first and second handle component hinged to the blade, and a latch. The latch includes a swinging portion coupled to a distal end of the first handle component and a receiving slot at a distal end of the second handle component. The latch works by having the swinging portion fittingly engage into the receiving slot to be able to lock the knife into an open and usable position and to also be able to lock the knife into a closed and stored position.

A latching mechanism used in conjunction with a butterfly knife may be cumbersome to latch and/or unlatch. Furthermore, the latch may become loose and will not properly hold the knife in either the open or closed position. An unreliable latch may cause the knife to unexpectedly open or close, thus leading to the injury of the user or to others. Also, it is desired that these knives be easily and quickly opened or closed by the user, especially in instances such as emergency and/or combat situations. It is a continued need and desire to provide latches or locks for butterfly knives that are more simplistic, easier, and safer to use. Furthermore, devices or components for helping the user move a butterfly knife between the open and the closed positions are continuously needed and desired as well.

Therefore, a need existed to provide a more reliable device for locking a butterfly knife. The device should be more simplistic, less cumbersome, and more reliable to use than prior art latches. The device must provide further safety and less hazard to the user and to others. The device must also be able to be moved relatively quickly between the open and closed positions.

SUMMARY OF THE INVENTION

In accordance with one embodiment of the present invention, it is an object of the present invention to provide an improved device for locking a butterfly knife.

It is another object of the present invention to provide an improved device for locking a butterfly knife that is more simplistic, less cumbersome, and more reliable to use than prior art locking mechanisms.

It is another object of the present invention to provide a device for locking a butterfly knife that is safer and less hazardous to the user and to others than prior art locking devices.

It is also another object of the invention to provide a device for locking a butterfly knife that allows the knife to be moved relatively quickly between the open and closed positions.

BRIEF DESCRIPTION OF THE PREFERRED EMBODIMENTS

In accordance with one embodiment of the present invention a device for locking a butterfly knife having a first handle component, a second handle component, and a blade hingedly coupled at a proximal end of the butterfly knife wherein the first and second handle components are moved to an open position and a closed position is disclosed. The device comprises a locking mechanism coupled to the proximal end of the butterfly knife. It is preferred, but not required, that the locking mechanism be placed at the proximal end of the butterfly knife. The locking mechanism has a thin plate with ridged edges attached to a proximal end of the first handle component. The locking mechanism also has at least one notch, existing on a proximal end of the second handle component, that is shaped to receive and anchor the ridged edges of the thin plate. The ridged edge of the thin plate on the first handle component engages the corresponding notch on the second handle component thus allowing the first and second handle components to be securely coupled to each other in an open position and also in a closed position.

In accordance with another embodiment of the present invention a device for locking a butterfly knife having a first handle component, a second handle component, and a blade hingedly coupled at a proximal end of the butterfly knife wherein the first and second handle components are moved to an open position and a closed position is disclosed. The device comprises a locking mechanism coupled to said proximal end of said butterfly knife. It is preferred, but not required, that the locking mechanism be placed at the proximal end of the butterfly knife. The locking mechanism has at least one movable magnetic component coupled to a proximal end of the first handle component and at least one fixed magnetic component existing on a proximal end of the second handle component. A thumb switch is coupled to the movable magnetic component so that by sliding the thumb switch the movable magnetic component is disengaged from the fixed magnetic component thereby disconnecting the first and second handle components. The attraction of the movable magnetic component to the fixed magnetic component allows the butterfly knife to be secured in an open position and also in a closed position.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiments when read in conjunction with the accompanying drawings, wherein like reference numerals and symbols represent like elements.

DETAILED DESCRIPTION

Figure 1:
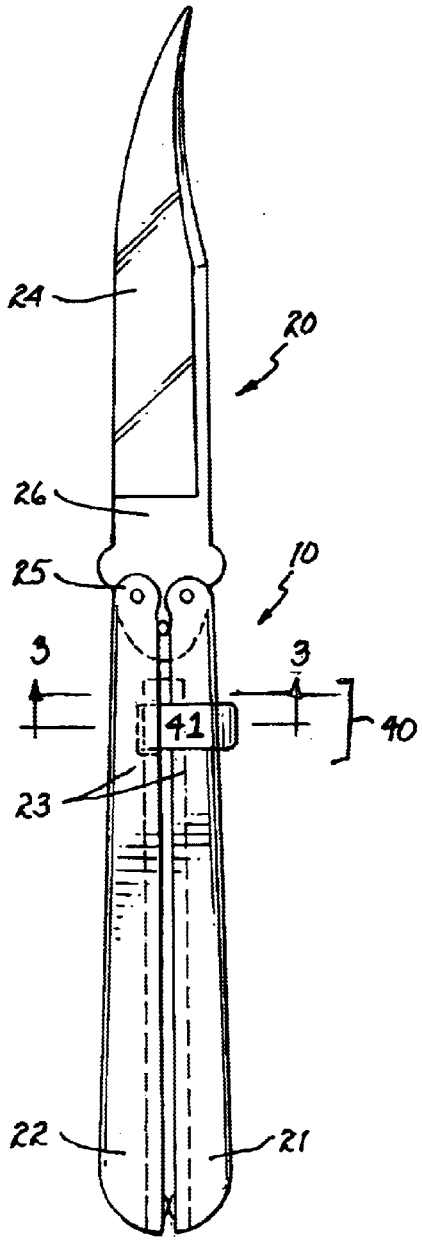
FIG. 1 is a side view of a butterfly knife with one embodiment of the thumb lock of the present invention wherein the butterfly knife is in the open and usable position.

Referring to FIGS. 1–12 wherein like numerals and symbols represent like elements, a thumb lock for a butterfly knife 10 (hereinafter thumb lock 10) is shown. The thumb lock 10 is used to secure a butterfly knife 20 in an open position and also in a closed position. The thumb lock 10 is preferred, but not required, to be located at the proximal end 25 of the butterfly knife 20 to make it easier to unlock, safer, and able to be moved relatively quickly between the open and closed positions.

Figure 2:
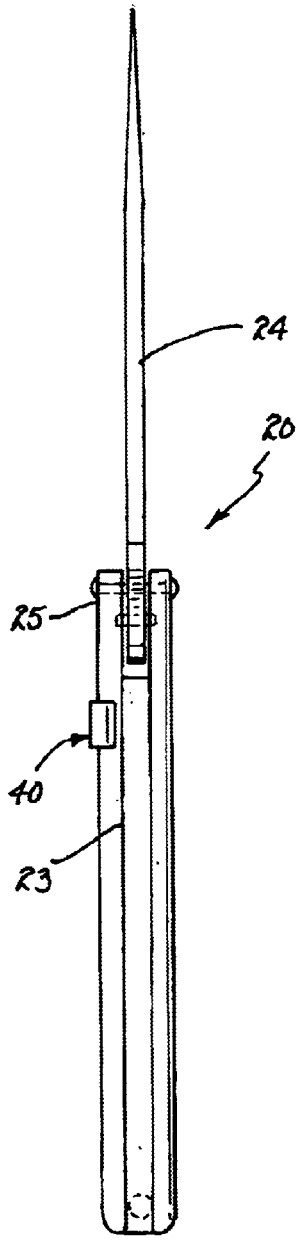
FIG. 2 is a front view of a butterfly knife with the thumb lock of FIG. 1 wherein the butterfly knife is in the open and usable position.
Figure 3:
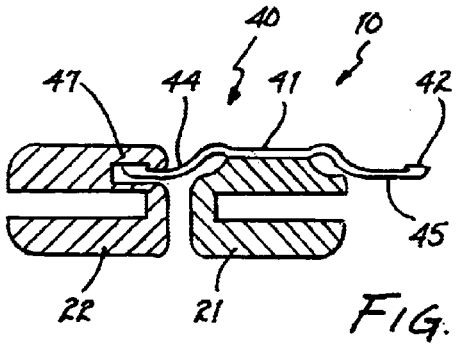
FIG. 3 is a cross-sectional view of the thumb lock used in the butterfly knife of FIG. 1, taken along line 3—3 of FIG. 1, wherein the butterfly knife is in the open and usable position.
Figure 4:
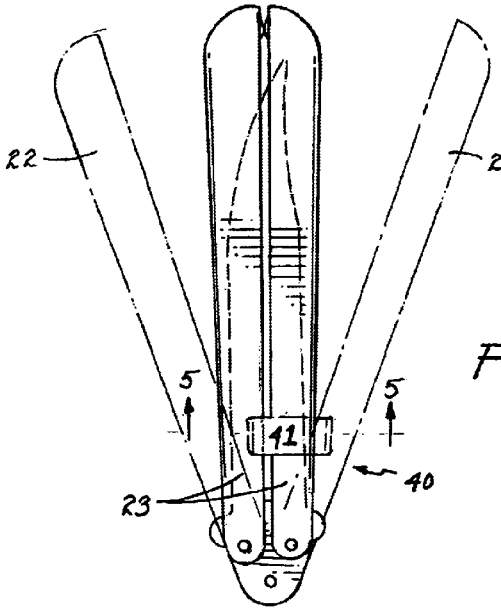
FIG. 4 is a side view of the butterfly knife with the thumb lock depicted in FIG. 1 wherein the butterfly knife is in the closed and stored position.
Figure 5:
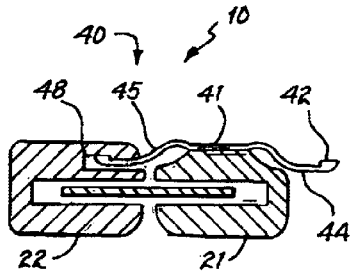
FIG. 5 is a cross-sectional view taken along lines 5—5 of FIG. 4 of the thumb lock used in the butterfly knife wherein the butterfly knife is in the closed and stored position.
Figure 7:
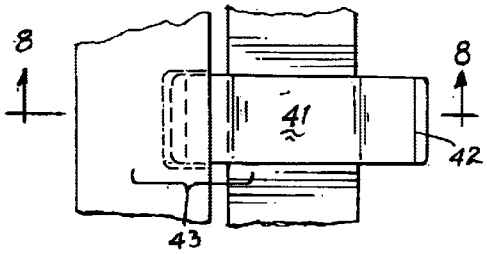
FIG. 7 is a partial side view of a butterfly knife with the thumb lock of FIG. 1.
Figure 6:
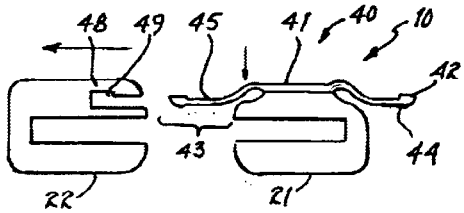
FIG. 6 is a cross-sectional view of the thumb lock used in the butterfly knife of FIG. 1 wherein the thumb lock is in the partially open position.
Figure 8:
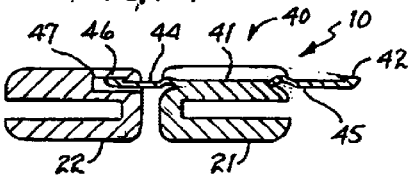
FIG. 8 is a cross-sectional view, taken along line 8—8 of FIG. 7, with the thumb lock of FIG. 1 wherein the butterfly knife is in the open and usable position.
Figure 9:
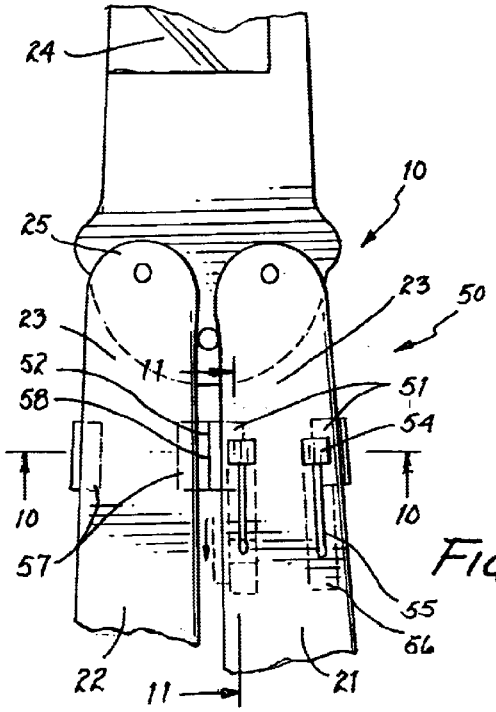
FIG. 9 is a partial side view of a butterfly knife with another embodiment of the thumb lock of the present invention wherein the butterfly knife is in the open and usable position.
Figure 11:
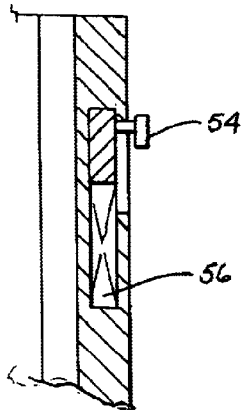
FIG. 11 is a partial side view of the butterfly knife with the thumb lock of FIG. 9.
Figure 10:
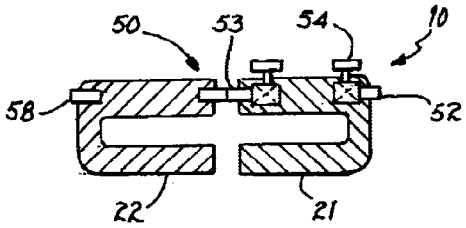
FIG. 10 is a cross-sectional view, taken along line 10—10 of FIG. 9, of the thumb lock of FIG. 9 with the butterfly knife in the closed and stored position.
Figure 12:
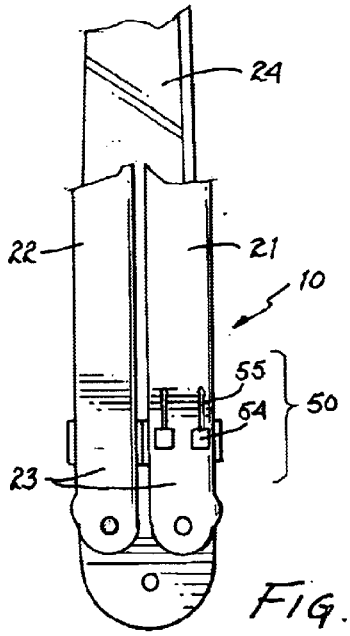
FIG. 12 is a partial side view of a butterfly knife with the thumb lock of FIG. 9 wherein the butterfly knife is in the closed and stored position.

FIGS. 1, 2, and 4 show a full view of a butterfly knife 20. A butterfly knife 20 generally has first handle component 21, a second handle component 22, a blade 24, and a locking mechanism 40. The proximal ends 23 of the first handle component 21 and the second handle component 22 are hingedly coupled to the proximal end 26 of the blade 24 thus allowing the butterfly knife 20 to move between an open and a closed position.

Referring to FIGS. 1–8, one embodiment of the locking mechanism 40 is shown. The locking mechanism 40 has a thin plate 41 coupled to the proximal end 23 of the first handle component 21. One end of the thin plate 41 will be inserted into the first handle component 21 or the second handle component 22 to lock the butterfly knife 20 in either the closed or open position.

In accordance with one embodiment of the present invention, the thin plate 41 has ridged edges 42 that are inserted into the second handle component 22 thereby connecting the first handle component 21 to the second handle component 22. The thin plate 41 also has an opening end 44 and a closing end 45. At the proximal end 23 of the second handle component 22 is an opening surface 47 and a closing surface 48. There is at least one notch 49 for receiving and anchoring the ridged edges 42 of the thin plate 41 on the opening surface 47 and on the closing surface 48. By inserting the opening end 44 into the at least one notch 49 on the opening surface 47, the butterfly knife 20 is secured in an open position. By inserting the closing end 45 into the at least one notch 49 on the closing surface 48, the butterfly knife 20 is secured in a closed position.

Referring to FIGS. 9–12, another embodiment of a locking mechanism 50 is shown. The locking mechanism 50 has at least one movable magnetic component 51 coupled to the proximal end 23 of the first handle component 21 and at least one fixed magnetic component 57 coupled to the proximal end 23 of the second handle component 22. The movable magnetic component 51 has a first opening surface 52 and a first closing surface 53. The fixed magnetic component 57 has a second opening surface 58 and a second closing surface 59. When the first opening surface 52 magnetically couples to the second opening surface 58, the butterfly knife 20 is secured in an open position. When the first closing surface 53 is coupled to the second closing surface 59, the butterfly knife 20 is secured in a closed position. A thumb switch 54 is coupled to the at least one movable magnetic component 51. By sliding the thumb switch 54, the at least one movable magnetic component 51 is disengaged from the at least one fixed magnetic component 57 thereby disconnecting the first handle component 21 from the second handle component 22. A spring 55 is housed within a groove 56 on the proximal end 23 of the first handle component 21. The spring 55 is contiguous to the thumb switch 54 and holds the at least one movable magnetic component 51 in a position always ready to meet the corresponding at least one fixed magnetic component 57.

It is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function. While the invention has been particularly shown and described with reference to preferred embodiments thereof, it will be understood by those skilled in the art that the foregoing and other changes in form and details may be made therein without departing from the spirit of and scope of the invention.

What is claimed is:

1. A device for locking a butterfly knife having a first handle component, a second handle component, and a blade hingedly coupled at a proximal end of the butterfly knife wherein the first and second handle components are moved to an open position and a closed position comprising:

at least one moveable magnetic component coupled to a proximal end of the first handle component for connecting the first handle component to the second handle component;

at least one fixed magnetic component coupled to a proximal end of the second handle component for connecting the second handle component to the first handle component;

a first opening surface on the at least one movable magnetic component and a second opening surface on the at least one fixed moveable magnetic component whereby the first opening surface couples to the second opening surface to allow the butterfly knife to be secured in the open position;

a first closing surface on the at least one moveable magnetic component and a second closing surface on the at least one fixed moveable magnetic component whereby the first closing surface couples to the second closing surface to allow the butterfly knife to be secured in the closed position;

a thumb switch coupled to the at least one movable magnetic component so that by sliding the thumb switch, the at least one moveable magnetic component is disengaged from the at least one fixed magnetic component and the first handle component is disconnected from the second handle component;

a spring that is contiguous to the thumb switch to keep the at least one moveable magnetic component on the proximal end of the first handle component in a position ready to meet the corresponding at least one fixed magnetic component on the proximal end of the second handle component; and a groove in the proximal end of the first handle component that contains the spring whereby attraction of the at least one moveable magnetic component to the at least one fixed magnetic component allows the butterfly knife to be secured in an open position and also a closed position.

2. A device for locking a butterfly knife having a first handle component, a second handle component, and a blade hingedly coupled at a proximal end of the butterfly knife comprising a locking mechanism coupled to the proximal end of the butterfly knife for securing the butterfly knife in an open position and a closed position, wherein the locking mechanism comprises:

at least one moveable magnetic component coupled to a proximal end of the first handle component for connecting the first handle component to the second handle component;

at least one fixed magnetic component coupled to a proximal end of the second handle component for connecting the second handle component to the first handle component; and a thumb switch coupled to the at least one movable magnetic component to control movement of the at least one moveable magnetic component to unlock the butterfly knife and allow the butterfly knife to move between the open position and the closed position.

3. The locking mechanism of claim 2 wherein the at least one moveable magnetic component has a first opening surface and a first closing surface and the at least one fixed magnetic component has a second opening surface and a second closing surface.

4. The locking mechanism of claim 3 wherein the thumb switch is coupled to the at least one moveable magnetic component and is slidable so that by sliding the thumb switch, the at least one moveable magnetic component is disengaged from the at least one fixed magnetic component for disconnecting the first handle component from the second handle component.

5. The locking mechanism of claim 4 wherein the first opening surface couples to the second opening surface to allow the butterfly knife to be secured in the open position and also where the first closing surface couples to the second closing surface to allow the butterfly knife to be secured in the closed position.

6. The locking mechanism of claim 3 further comprising a spring that is contiguous to the thumb switch to keep the at least one moveable magnetic component on the proximal end of the first handle component in a position ready to meet the corresponding at least one fixed magnetic component on the proximal end of the second handle component.

7. The locking mechanism of claim 6 further comprising a groove in the proximal end of the first handle component that contains the spring.

* * * * *